US010575709B2

(12) United States Patent
Nowell, Jr. et al.

(10) Patent No.: US 10,575,709 B2
(45) **Date of Patent: *Mar. 3, 2020**

(54) RACK ASSEMBLY FOR A DISHWASHER

(71) Applicant: Whirlpool Corporation, Benton Harbor, MI (US)

(72) Inventors: Ronald M. Nowell, Jr., Saint Joseph, MI (US); Daniel W. Southworth, South Bend, IN (US); Matthew M. Hansen, Saint Joseph, MI (US); Joseph T. Ferencevich, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/299,361

(22) Filed: Mar. 12, 2019

(65) Prior Publication Data

US 2019/0208983 A1 Jul. 11, 2019

Related U.S. Application Data

(63) Continuation of application No. 15/973,643, filed on May 8, 2018, now Pat. No. 10,292,567, which is a continuation of application No. 15/228,195, filed on Aug. 4, 2016, now Pat. No. 10,010,239.

(51) Int. Cl.

| | |
|---|---|
| ***A47L 15/50*** | (2006.01) |
| ***A47L 15/46*** | (2006.01) |
| ***A47L 15/42*** | (2006.01) |

(52) U.S. Cl.

CPC ..... *A47L 15/507* (2013.01); *A47L 15/428* (2013.01); *A47L 15/4225* (2013.01); *A47L 15/4257* (2013.01); *A47L 15/4285* (2013.01); *A47L 15/4293* (2013.01); *A47L 15/46* (2013.01)

(58) Field of Classification Search

CPC ..... A47L 15/4225; A47L 15/4257; A47L 15/428; A47L 15/507; A47L 15/4293; A47L 15/46; A47L 15/4285

See application file for complete search history.

(56) References Cited

U.S. PATENT DOCUMENTS

| | | | |
|---|---|---|---|
| 2,734,520 | A | 2/1956 | Abresch et al. |
| 3,861,769 | A | 1/1975 | Jenkins |
| 4,226,490 | A | 10/1980 | Jenkins et al. |
| 4,449,765 | A | 5/1984 | Lampman |
| 5,730,301 | A | 3/1998 | Welch et al. |
| 7,011,317 | B1 | 3/2006 | Hicks et al. |
| 2006/0250058 | A1 | 11/2006 | Stevens et al. |
| 2008/0210275 | A1 | 9/2008 | Woo et al. |

(Continued)

FOREIGN PATENT DOCUMENTS

| | | | |
|---|---|---|---|
| DE | 102009002671 | A1 | 10/2010 |
| JP | S4823828 | Y1 | 11/1973 |

*Primary Examiner* — Michael E Barr
*Assistant Examiner* — Benjamin L Osterhout
(74) *Attorney, Agent, or Firm* — McGarry Bair PC

(57) ABSTRACT

A rack assembly for an automatic dishwasher having opposing side portions, at least two axles extending outwardly from each of the opposing side portions, and a roller wheel mounted to each axle. Each roller wheel roller wheel has a hub adapted to be fixedly attached to the axle, and a wheel rotatably mounted to the hub. A plurality of separators that define pockets is integrally molded with one of the hub or the wheel. Each pocket is adapted to contain one ball bearing such that no two adjacent ball bearings make contact.

17 Claims, 12 Drawing Sheets

(56) References Cited

U.S. PATENT DOCUMENTS

| | | | |
|---|---|---|---|
| 2009/0151758 | A1 | 6/2009 | Kristensson et al. |
| 2013/0125937 | A1 | 5/2013 | Baldwin et al. |
| 2013/0300270 | A1 | 11/2013 | Garnett et al. |
| 2015/0190034 | A1 | 1/2015 | Jeong et al. |

100

300

RACK ASSEMBLY FOR A DISHWASHER

CROSS-REFERENCE TO RELATED APPLICATIONS

This application claims the benefit of and is a continuation of U.S. patent application Ser. No. 15/973,643, entitled "Rack Assembly for a Dishwasher," filed May 8, 2018, now U.S. Pat. No. 10,292,567, which is a continuation of U.S. patent application Ser. No. 15/228,195, entitled "Rack Assembly for a Dishwasher," filed Aug. 4, 2016, now U.S. Pat. No. 10,010,239, all of which are incorporated herein by reference in their entirety.

BACKGROUND OF THE INVENTION

Contemporary automatic household dishwashers may have either a single compartment or multiple compartments for receiving soiled utensils to be treated. Typically, dishwashers with a single compartment have a single tub at least partially defining a treating chamber and a hinged door that provides access to the treating chamber. Multiple racks slidably mounted to the tub and movable relative to the treating chamber support the utensils. In multiple compartment dishwashers, the compartments are often in the form of multiple, separate drawers or pull-out compartments. Each compartment can include a slidable tub at least partially defining a treating chamber. One or more racks in the multiple compartment dishwashers may be disposed inside and moveable with its respective treating chamber to support the utensils in the treating chamber.

BRIEF DESCRIPTION OF THE INVENTION

One aspect of the present invention relates to a rack assembly for an automatic dishwasher comprising: at least one side portion; an axle extending outwardly from the side portion; a roller wheel comprising a hub mounted to the axle, a wheel mounted to the hub, a raceway having a plurality of ball bearings rotationally coupling either the hub to the axle or the wheel to the hub; and a plurality of separators defining pockets and integrally molded with one of the hub or the wheel, wherein each pocket is adapted to contain one ball bearing such that no two adjacent ball bearings make contact.

Another aspect of the present invention relates a roller wheel for a dishwasher rack comprising: a hub having a first raceway; and a wheel having a central bore with a second raceway on the bore, mounted to the hub with the first raceway facing the second raceway; and a plurality of separators defining pockets and integrally molded with one of the first raceway or second raceways; wherein each pocket is adapted to contain one ball bearing such that no two adjacent ball bearings make contact.

Yet another aspect of the present invention relates an automatic dishwasher comprising; a tub with an open front and a door selectively movable about a horizontal axis between a closed position blocking access to the tub through the open front and an open position enabling access to the tub through the open front; a dishwasher rack having at least one side portion; rails mounted to the tub; and at least one axle extending outwardly from the side portion; a roller wheel mounted to the axle, wherein the roller wheel comprises a hub adapted to be fixedly attached to the axle, and a wheel rotatably mounted to the hub; and a plurality of separators defining pockets and integrally molded with one of the hub or the wheel; wherein each pocket is adapted to contain one ball bearing such that no two adjacent ball bearings make contact.

DESCRIPTION OF EMBODIMENTS OF THE INVENTION

Figure 1:
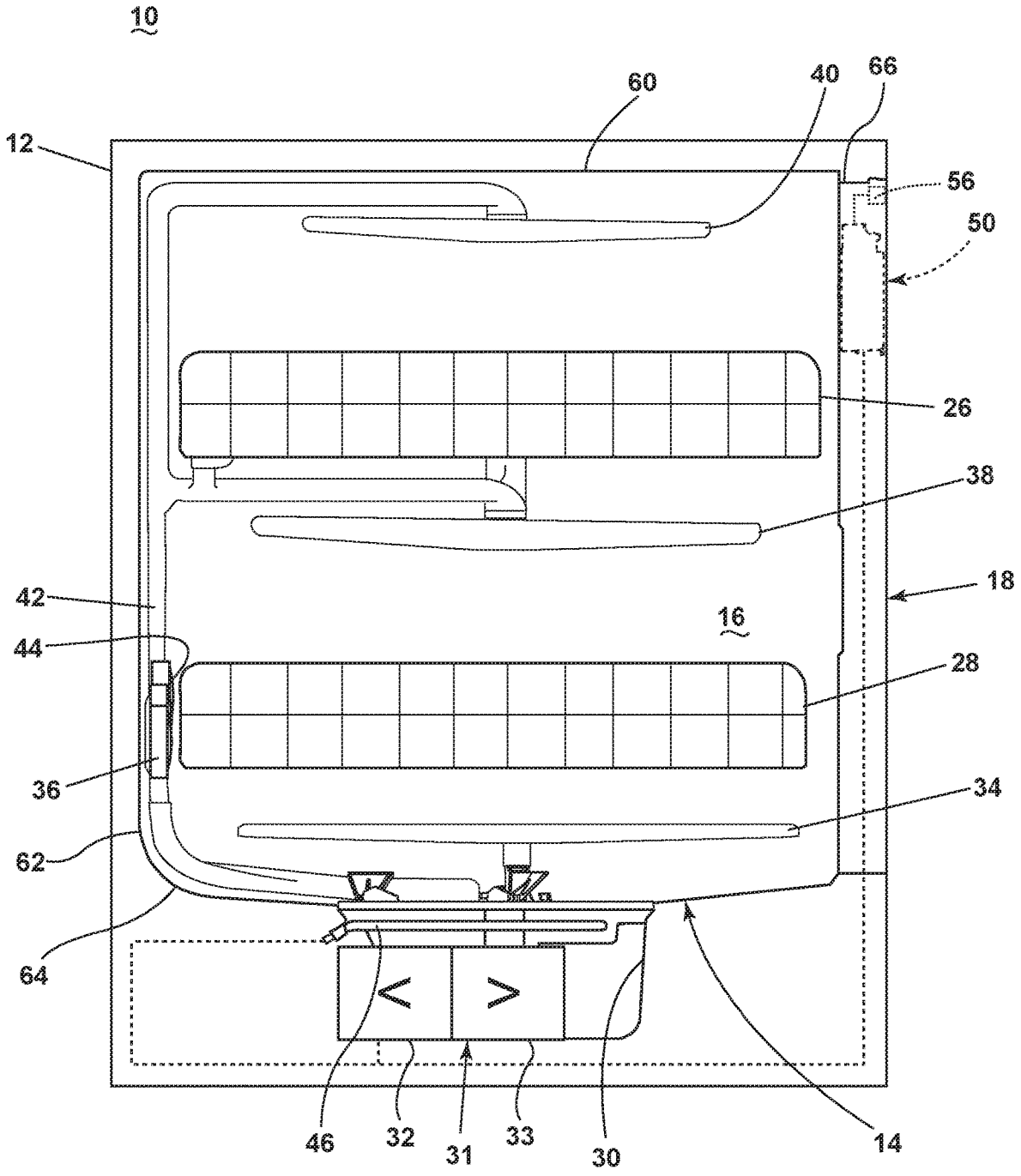
FIG. 1 is a schematic, cross-sectional view of a dishwasher according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
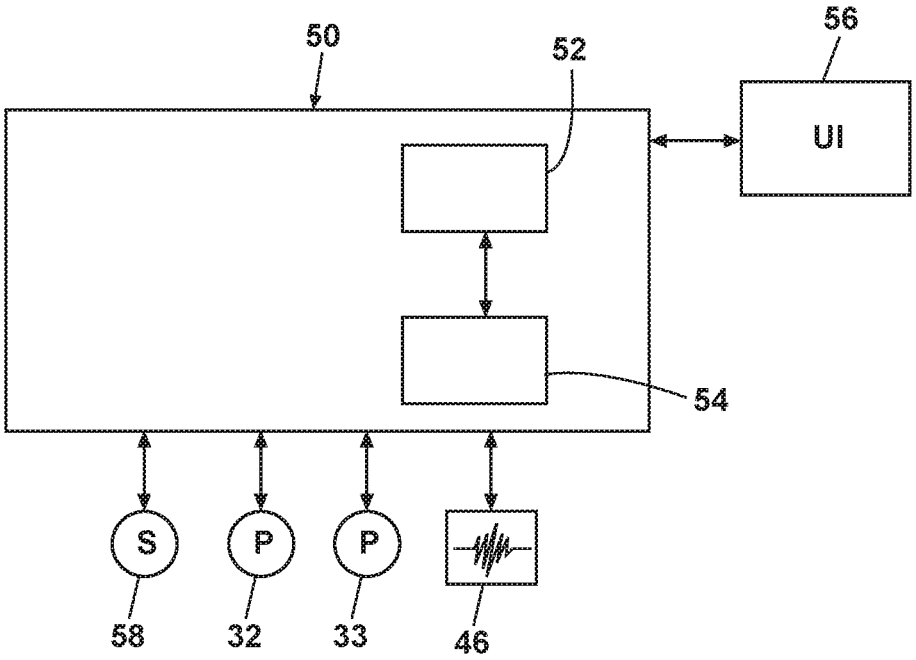
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
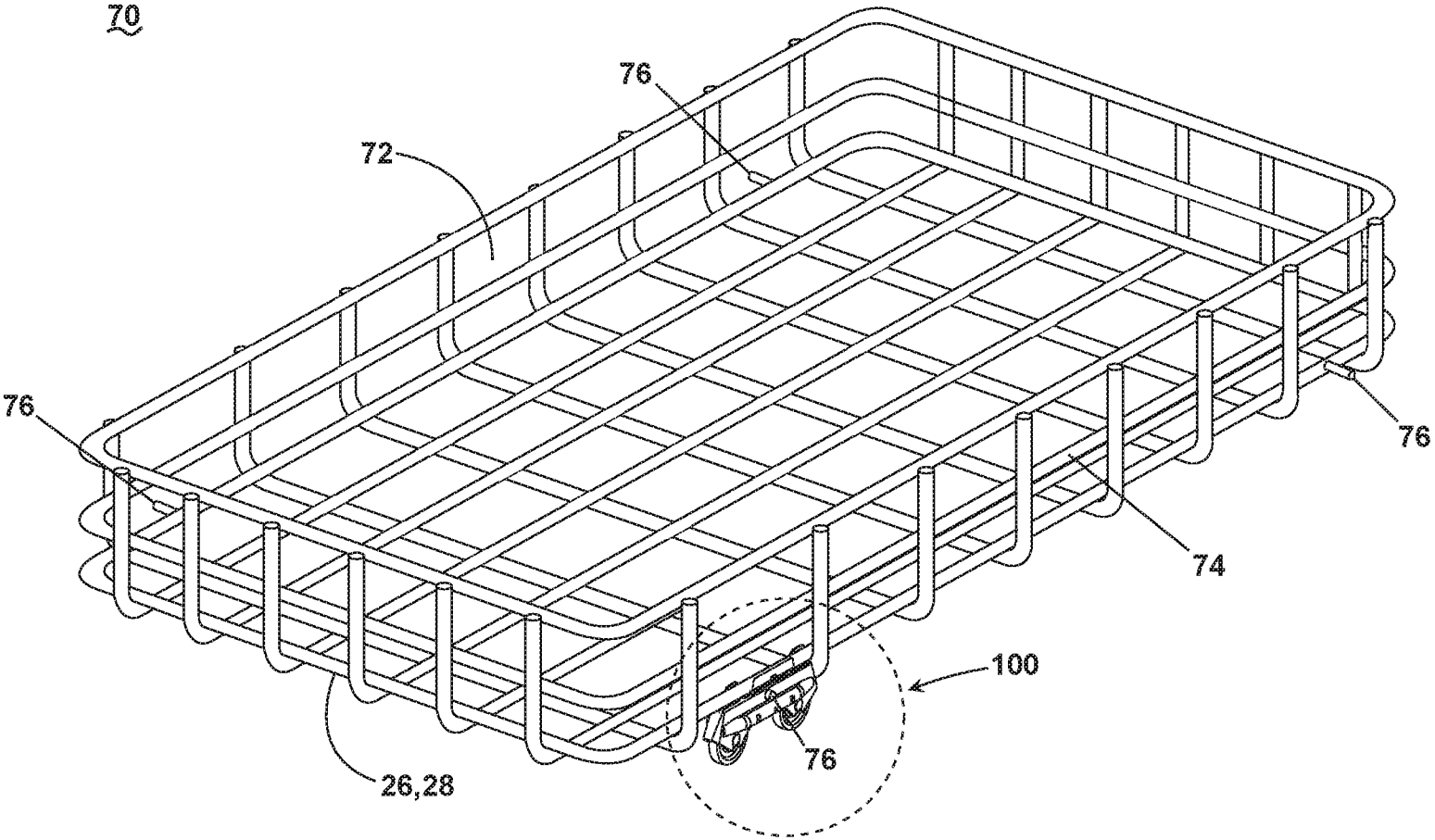
FIG. 3 is an isometric view of a rack for a dishwasher with one wheel assembly attached.
Figure 4:
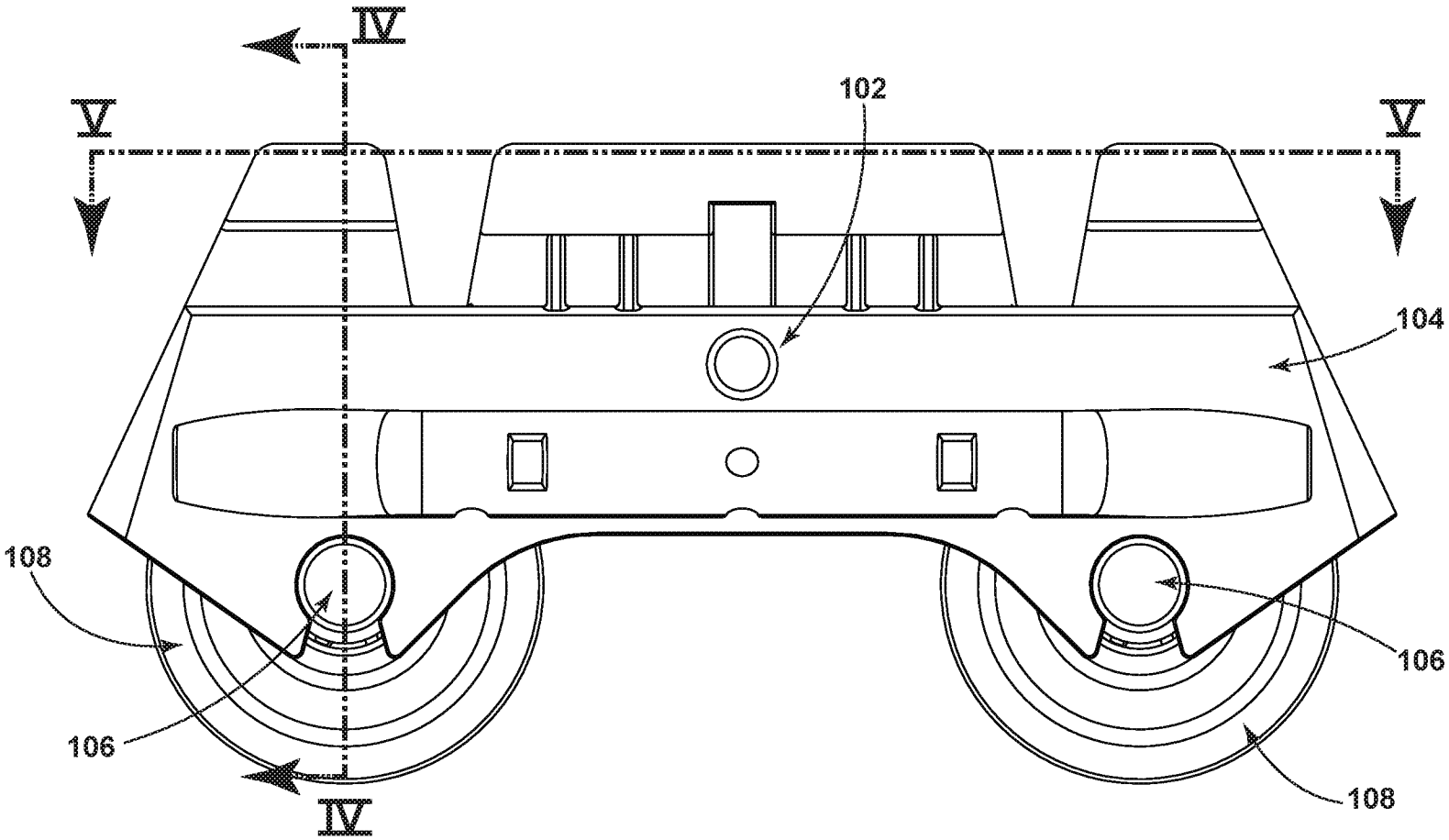
FIG. 4 is a side view of a wheel assembly for the rack of a dishwasher according to a first embodiment of the invention.
Figure 5:
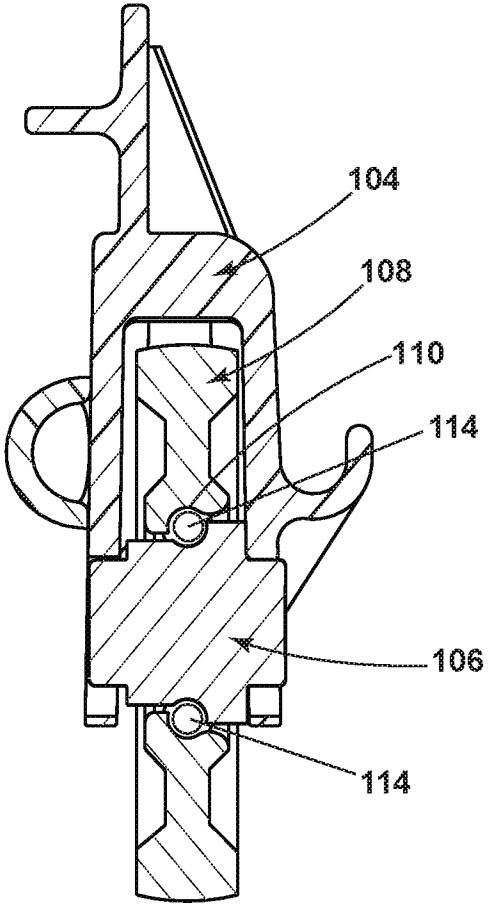
FIG. 5 is a cross section of the wheel assembly of FIG. 4 along line V-V'.
Figure 6:
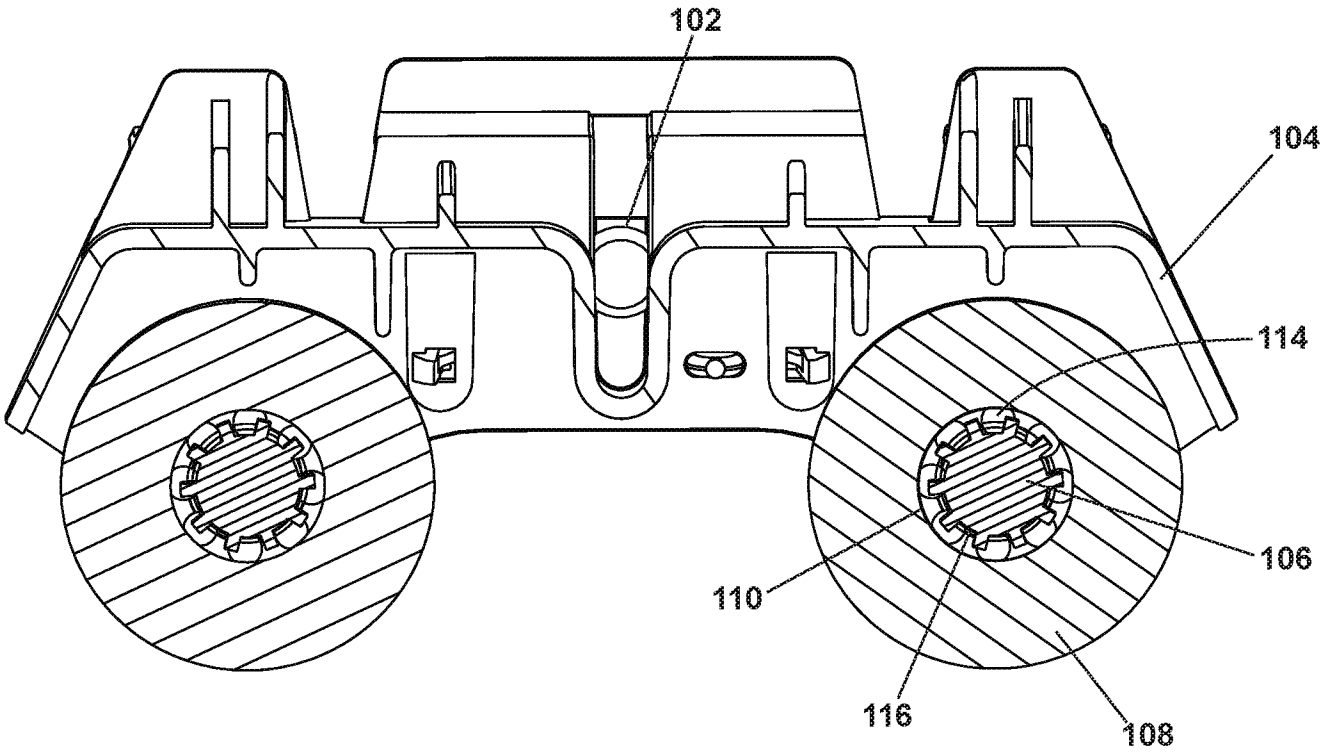
FIG. 6 is a cross section of the wheel assembly of FIG. 4 along line VI-VI'.
Figure 7:
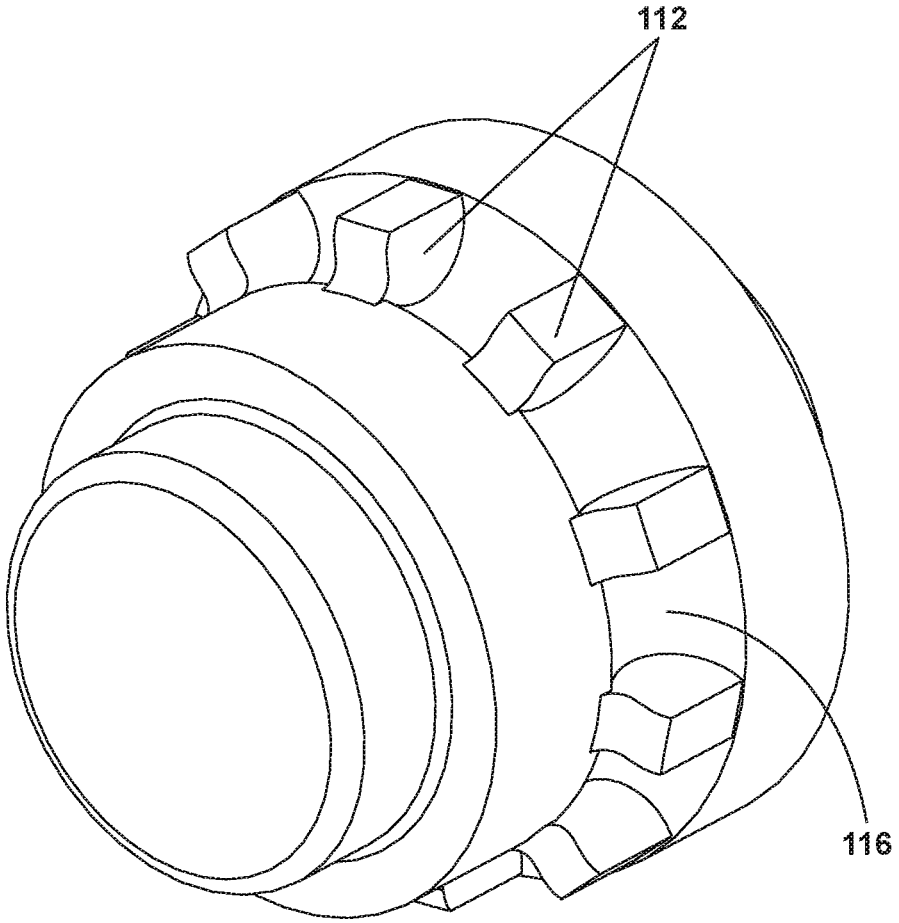
FIG. 7 is an isometric view of a portion of a wheel assembly for the rack of a dishwasher according to a second embodiment of the invention.

FIG. 3 illustrates a rack assembly 70 for a dishwasher according to a first embodiment of the inventive concept. The rack assembly 70 comprises of one of the upper rack 26 or the lower rack 28, with opposing side portions 72 and 74, and having axles 76 extending outwardly from each of the opposing side portions, along with the roller wheels 100 mounted onto each axle 76 as shown in FIG. 3. Looking also now at FIG. 4, the roller wheel 100 is mounted to an axle 76 of the rack assembly 70 when the axle 76 is received in a hole 102 in a plate 104. The roller wheel 100 further comprises two roller wheels 108 coupled to the plate 104, by way of two respective wheel axles 106. Looking now also at FIGS. 5-7, a raceway 110 is provided on an inner circumference of each roller wheel 108. Separators 112 are provided on an outer circumference of each wheel axle 106 that partially define pockets 116 between adjacent separators. Ball bearings 114 are interspersed between the separators 112 in the pockets 116. When the roller wheel 108 is assembled to the wheel axle 106, the raceway 110 and the separators 112 together define the pockets 116 containing the ball bearings 114. This assembly enables no two ball bearings to come into contact with one another during operation, thereby reducing noise generation and improving product elegance.

Figure 8:
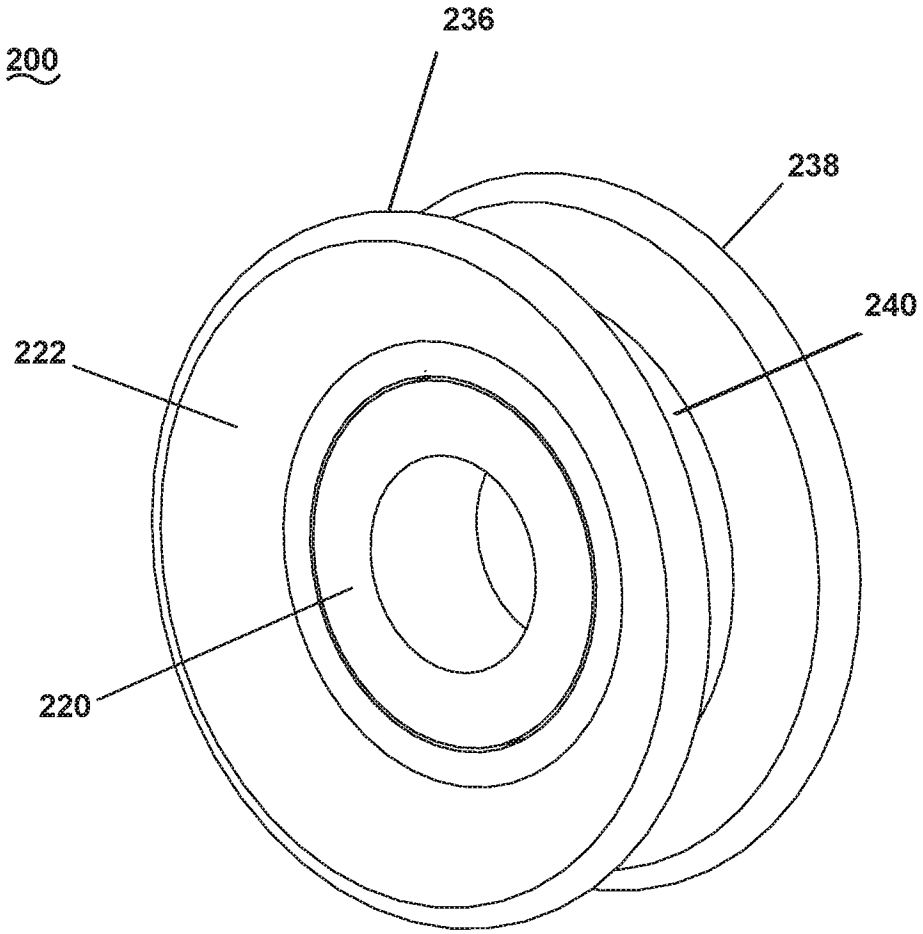
FIG. 8 is an isometric view of a portion of a wheel assembly for the rack of a dishwasher according to the second embodiment of the invention.
Figure 9:
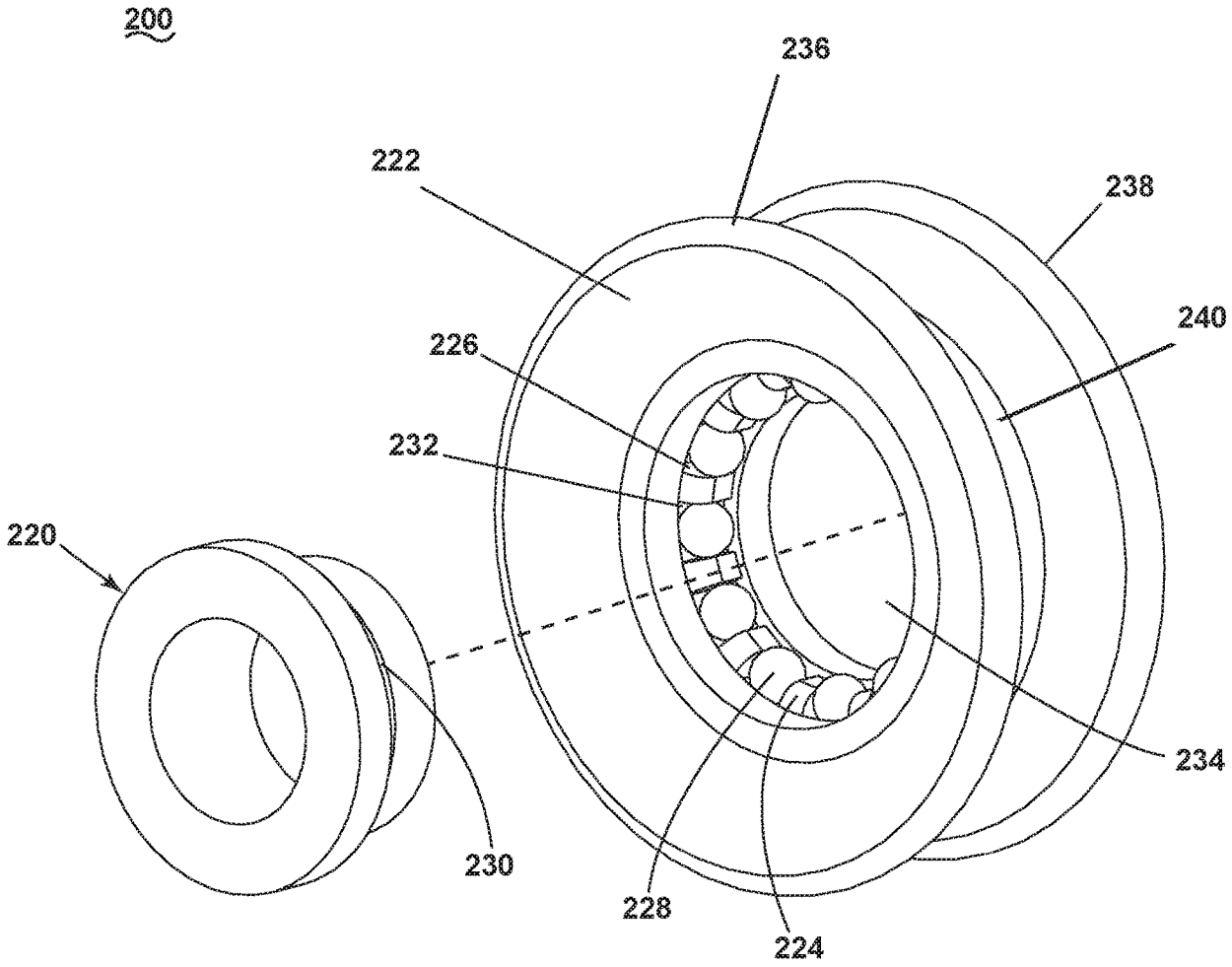
FIG. 9 is an exploded view of the wheel assembly according to the second embodiment of the invention.

FIG. 8 and FIG. 9 illustrate a roller wheel 200 according to a second embodiment of the inventive concept. Here, the roller wheel 200 comprises a hub 220, a wheel 222, separators 224, pockets 226, and ball bearings 228. The roller wheel 200 also comprises a first raceway 230 located on a perimeter of the hub and a second raceway 232 located on the perimeter of a bore 234 in wheel 222. When the wheel 222 is mounted onto the hub 220, the first raceway 230 faces the second raceway 232 and thus defines the pockets 226, in which are contained the ball bearings 228. The hub 220 is fixed onto the axle 76. The wheel 222 has two opposing walls 236 and 238 that enclose a channel 240, enabling the lack of movement of the roller wheel 200 in either axial direction, while moving along a structure that fits into the channel 240, including but not limited to a guide rail.

Figure 10:
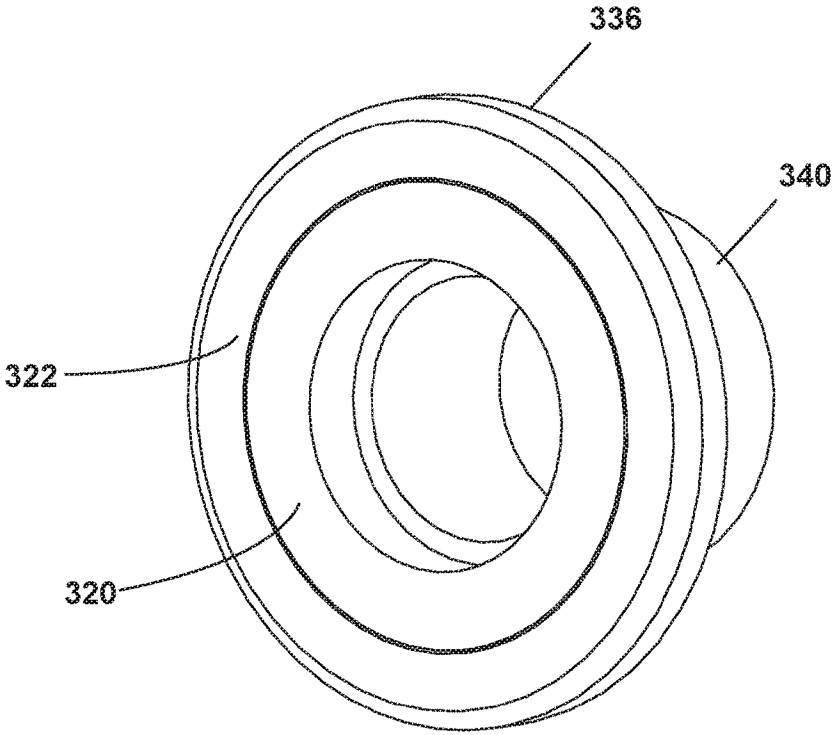
FIG. 10 is an isometric view of a wheel assembly for the rack of a dishwasher according to a third embodiment of the invention.
Figure 11:
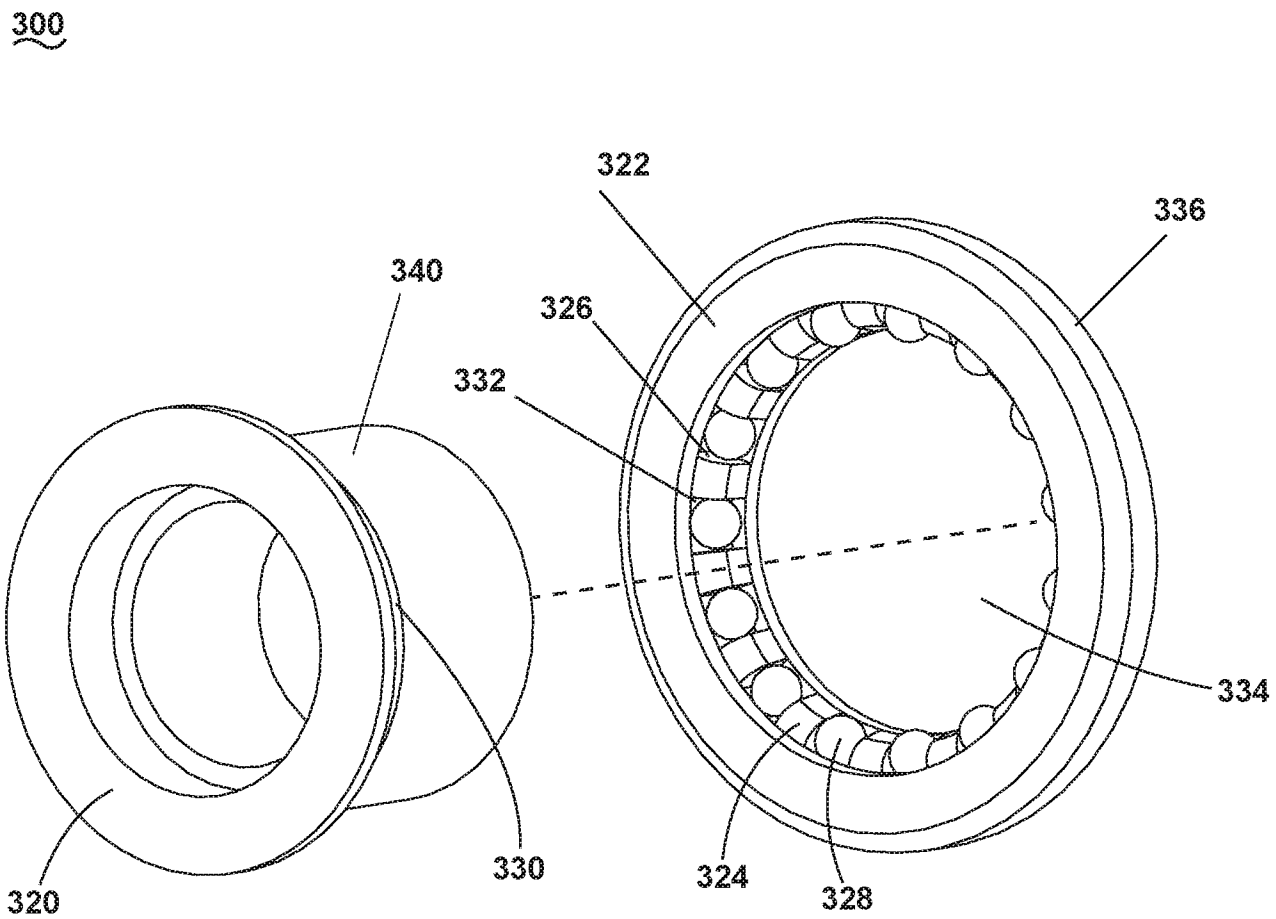
FIG. 11 is an exploded view of the wheel assembly of FIG. 10.
Figure 12:
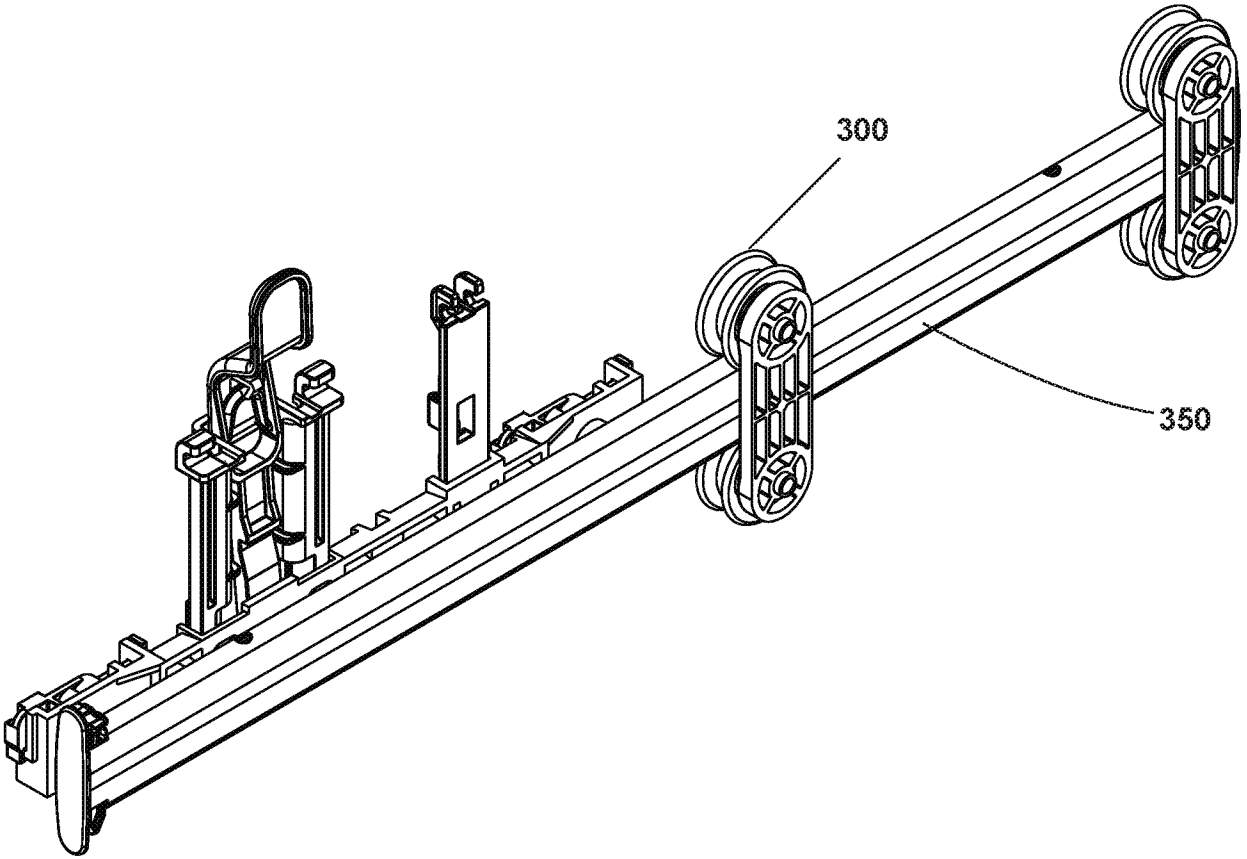
FIG. 12 is an implementation of the wheel assembly of FIG. 10.

FIG. 10 and FIG. 11 illustrate a roller wheel 300 according to a third embodiment of the inventive concept. The third embodiment is substantially similar to the second embodiment, hence similar parts are marked with part numerals increased by 100. As opposed to the second embodiment, the third embodiment only has one opposing wall 336 partially enclosing a channel 340. The wall 336 enables lack of movement of the roller wheel 300 in a single axial direction, while moving along a structure that fits into the channel 340, including but not limited to a guide rail 350. The roller wheel 300 in the context of the guide assembly 350 is illustrated in FIG. 12.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A rack assembly for an automatic dishwasher comprising:

at least one side portion;

an axle extending outwardly from the side portion;

a roller wheel comprising a hub mounted to the axle, a wheel mounted to the hub, a raceway having a plurality of ball bearings rotationally coupling either the hub to the axle or the wheel to the hub; and a plurality of separators defining pockets and integrally molded with one of the hub or the wheel, wherein each pocket is adapted to contain one ball bearing such that no two adjacent ball bearings make contact.

2. The rack assembly of claim 1 wherein the separators project into the raceway.

3. The rack assembly of claim 1 wherein the hub and the wheel are formed of plastic and the ball bearings are formed of stainless steel.

4. The rack assembly of claim 1 wherein the hub is snap fit to the axle.

5. The rack assembly of claim 1 wherein the wheel is snap fit to the hub via the ball bearings in a raceway.

6. The rack assembly of claim 1 wherein the raceway comprises a first raceway on the hub and a second raceway on the wheel.

7. The rack assembly of claim 6 wherein the first and second raceways confronting each other.

8. A roller wheel for a dishwasher rack comprising:

a hub having a first raceway; and a wheel having a central bore with a second raceway on the bore, mounted to the hub with the first raceway facing the second raceway; and a plurality of separators defining pockets and integrally molded with one of the first raceway or second raceways;

wherein each pocket is adapted to contain one ball bearing such that no two adjacent ball bearings make contact.

9. The roller wheel of claim 8 wherein the first raceway is mounted on a perimeter of the hub and the second raceway is mounted on a perimeter of the bore.

10. The roller wheel of claim 8 wherein the wheel is snap fit to the hub.

11. The roller wheel of claim 8 wherein the hub and the wheel are formed of plastic and the ball bearings are formed of stainless steel.

12. The roller wheel of claim 8 wherein the separators project into one of the first or second raceways that holds the ball bearings.

13. An automatic dishwasher comprising;

a tub with an open front and a door selectively movable about a horizontal axis between a closed position blocking access to the tub through the open front and an open position enabling access to the tub through the open front;

a dishwasher rack having at least one side portion;

rails mounted to the tub; and at least one axle extending outwardly from the side portion;

a roller wheel mounted to the axle, wherein the roller wheel comprises a hub adapted to be fixedly attached to the axle, and a wheel rotatably mounted to the hub; and a plurality of separators defining pockets and integrally molded with one of the hub or the wheel;

wherein each pocket is adapted to contain one ball bearing such that no two adjacent ball bearings make contact.

14. The automatic dishwasher of claim 13 wherein one of the hub or the wheel has a raceway that holds the ball bearings.

15. The automatic dishwasher of claim 13 wherein the separators project into a raceway that holds the ball bearings.

16. The automatic dishwasher of claim 13 wherein the hub and the wheel are formed of plastic and the ball bearings are formed of stainless steel.

17. The automatic dishwasher of claim 13 wherein the hub is snap fit to the axle.

* * * * *